United States Patent [19]

Takenaka et al.

[11] Patent Number: 5,032,756

[45] Date of Patent: Jul. 16, 1991

[54] COLOR CATHODE RAY TUBE AND ENVELOPE FOR USE WITH THE COLOR CATHODE RAY TUBE

[75] Inventors: Shigeo Takenaka; Takashi Nishimura, both of Fukaya, Japan

[73] Assignee: Kabushiki Kaisha Toshiba, Kawasaki, Japan

[21] Appl. No.: 395,076

[22] Filed: Aug. 17, 1989

[30] Foreign Application Priority Data

Aug. 30, 1988 [JP] Japan ..... 63-213696
Aug. 30, 1988 [JP] Japan ..... 63-213697

[51] Int. Cl.[5] ..... H01J 31/00

[52] U.S. Cl. ..... 313/2.1; 313/477 R; 313/482

[58] Field of Search ..... 313/21, 477 R, 482, 313/476; 220/2.1 A, 2.3 A

[56] References Cited

U.S. PATENT DOCUMENTS 2,782,952 2/1957 Dalton et al. ..... 220/2.3 A
2,920,785 1/1960 Veres ..... 220/2.3 A
3,404,769 10/1968 Bishop ..... 220/2.3
3,482,726 12/1969 Schroeder, Jr. ..... 220/2.3 A
3,632,008 1/1972 Lind ..... 220/2.3 A
4,712,038 12/1987 Takenaka et al. ..... 313/2.1
4,713,520 12/1987 Van Nice et al. ..... 313/477 R
4,714,856 12/1987 Takenaka et al. ..... 313/2.1
4,792,720 12/1988 Takenaka et al. ..... 313/409

FOREIGN PATENT DOCUMENTS 0201865 11/1986 European Pat. Off. .
0257676 3/1988 European Pat. Off. .

*Primary Examiner*—Palmer C. DeMeo
*Assistant Examiner*—Michael Horabik
*Attorney, Agent, or Firm*—Cushman, Darby & Cushman

[57] ABSTRACT

A color cathode ray tube and an envelope for use with the color cathode ray tube in which a metal plate is interposed between a panel section and a plurality of funnel and neck sections, each of which combination having one electron gun disposed internally. The overall length of the envelope thus constructed can thus be shortened in the direction of the tube axis. The structure of the envelope can also be more simply made and ease of production provided. Further, the envelope can be made lighter in weight.

20 Claims, 13 Drawing Sheets

COLOR CATHODE RAY TUBE AND ENVELOPE FOR USE WITH THE COLOR CATHODE RAY TUBE

BACKGROUND OF THE INVENTION

1. Field of the Invention

The present invention relates to a color cathode ray tube and, more particularly, it relates to the structure of an envelope provided with plural necks and a color cathode ray tube provided with this envelope.

2. Description of the Related Art

The conventional color cathode ray tube provided with a plurality of necks is shown in FIG. 1. As disclosed in Japanese Patent Disclosure No. Sho 61-256551, this color cathode ray tube 1 includes envelope 11 comprising panel section 2 provided with a substantially rectangular face plate 4 and a skirt 6 extending from the circumferential rim of face plate 4, a funnel section 8 connected to a panel section 2, and a plurality neck sections 10 continuous from funnel section 8. The inside of cathode ray tube 1 is kept in a vacuum by the panel, the funnel and neck sections 2, 8 and 10. An electron gun assembly 12 for shooting three electron beams is housed in each of a neck sections 10. The funnel and neck sections 8 and 10 are provided, on the outer surface thereof, with a deflection means 14 for generating a magnetic field to deflect the electron beams in the horizontal and vertical directions. A phosphor screen 16 is formed on the inner surface of the face plate 4 at the panel section 2. A substantially rectangular shadow mask 18 is arranged inside the tube, facing the phosphor screen 16 with a certain interval interposed between them. The shadow mask 18 is made of a thin metal plate and is provided with a plurality of slit apertures 20. Frame 22 is attached to the circumferential rim of shadow mask 18.

Three electron beams shot from each of the electron guns 12 are deflected by deflection means 14. FIG. 1 shows those areas where the three electron beams are deflected. The electron beams thus deflected converge on the phosphor screen 16. The electron beams thus converged are introduced onto the phosphor screen 16 to emit the three colors of red, green and blue. Phosphor screen 16, which is scanned by the electron beams shot from electron guns 12, is sectioned to correspond to each of electron guns 12.

In the case of the envelope having the above-described structure to be used as the color cathode ray tube, the distance extending from the face plate to the neck can be made shortened as compared with another envelope, the same in size, but having only one neck section. This is because that area of the phosphor screen which is scanned by the electron gun housed in the neck section can be made smaller and the distance between the electron gun and the phosphor screen can thus be shortened. As the envelope is made larger in size, the effect of making this distance shorter can be enhanced further and further. In the case where the panel, funnel and neck sections are all made of glass, however, they cannot be made so sharply-curved as to make the distance between the electron gun and the phosphor screen shorter because the material of which they are made is glass. An envelope made of glass is therefore limited in how short the distance can be made.

The envelope having the above-described arrangement to be used as the color cathode ray tube has an extremely more complicated shape as compared with the other envelopes which are intended for the common color cathode ray tubes. In common color cathode ray tubes, this envelope is made of glass. It is therefore quite difficult to process glass to the complicated shape of this envelope. This makes it difficult to put this envelope into mass production.

This envelope is made to resist atmospheric pressure so as to maintain an inside vacuum. When it is large in size, quite a large force is added to it because of atmospheric pressure. It is therefore necessary for the thickness of the glass funnel section to be substantially the same as that of the glass panel section. However, a distortion of the glass neck section by the pressure is relatively small. It is therefore unnecessary to make the thickness of the glass neck section large. The glass neck section may be about 1 mm thick, for example. The thickness of glass thus changes sharply from the funnel to the neck section and this changes heat capacity sharply at the portion where the glass shifts from the funnel to the neck section. During manufacture, heat is applied to the envelope at a plurality processes thus increasing its thermal distortion. Because the envelope is made more likely to be broken because of thermal distortion, it is difficult to put the glass envelope on a mass production line. Further, the thickness of the funnel section is made substantially the same as that of the panel section. When the envelope is large in size, therefore, it becomes quite heavy. When it is heavy, it increases the weight of the color cathode ray tube for which it is intended.

SUMMARY OF THE INVENTION

The object of the present invention is to provide an envelope having a plurality of neck sections and a color cathode ray tube which uses this envelope, said envelope enabling the depth to be made shorter, and said color cathode ray tube enabling the distance between the electron gun and the phosphor screen to be made shorter, its weight to be made lighter and its mass production to be made easier.

According to the present invention, there can be provided a vacuum envelope for using cathode ray tube comprising a plurality of funnel sections having a front and rear sides, a plurality of neck sections on the rear side of each of the funnel sections, a panel section including a face plate having an inner surface, a skirt extending from a peripheral edge of the face plate, and a metal connecting means for connecting the front side of each of the funnel sections to the skirt of the panel section, the metal connecting means have a main surface substantially parallel to the inner surface of the face plate, and include on that main surface a plurality of openings corresponding to the front sides of each of the funnel sections.

According to the present invention, there can be provided a vacuum envelope for using cathode ray tube comprising a plurality of funnel sections each having a front and a rear side, a plurality of neck sections on each rear side of the funnel section, a panel section including a face plate having an inner surface, a skirt extending from a peripheral edge of the face plate, a metal connecting means for connecting the front side of each of the funnel sections to the skirt of the panel section, the metal connecting means having a main surface substantially parallel to the inner surface of the face plate and a plurality of openings corresponding to the front sides of the funnel sections, a plurality of first insertion means having a thermal expansion coefficient lower than that of the metal connecting means for insertion between the front side of each funnel section and the metal connecting means, and a plurality of second insertion means having a thermal expansion coefficient lower than that of the metal connecting means for insertion between the skirt of the panel section and the metal connecting means.

According to the present invention, there can be provided a color cathode ray tube comprising a vacuum envelope comprising a plurality of funnel sections having a front and a rear side, a like plurality of neck sections on the rear sides of each funnel section, a panel section including a face plate having an inner surface, a skirt extending from a peripheral edge of the face plate, a metal connecting means for connecting the front side of each at the funnel sections to the skirt of the panel section, the metal connecting means having a main surface substantially parallel to the inner surface of the face plate, the main surface further including a plurality of openings corresponding to the front side of each of the funnel sections, a phosphor screen on the inner surface of the face plate, a shadow mask disposed near the phosphor screen, and a plurality of electron gun assemblies in each of the neck sections, respectively.

According to the present invention, there can be provided a color cathode ray tube comprising a vacuum envelope comprising a plurality of funnel sections each having a front and a rear side, a plurality of neck sections on the rear side of each of the funnel sections, a panel section including a face plate having an inner surface, a skirt extending from a peripheral edge of the face plate, a metal connecting means for connecting the front sides of each funnel section to the skirt of the panel section, the metal connecting means having a main surface substantially parallel to the inner surface of the face plate, with the main surface being provided with a plurality of openings corresponding to the front side of each funnel section, a plurality of first insertion means having a thermal expansion coefficient lower than that of the metal connecting means for insertion between the front side of each funnel and the metal connecting means, and, a plurality of second insertion means having a thermal expansion coefficient lower than that of the metal connecting means for insertion between the skirt of the panel section and the metal connecting means, a phosphor screen on the inner surface of the face plate, a shadow mask disposed near the phosphor screen, and a plurality of electron gun assemblies in each neck section, respectively.

According to the present invention, the envelope is provided with a metal connecting means (a rear plate made of metal). The distance between the phosphor screen and the electron gun in the envelope can be thus made shorter. In addition, the envelope can be made lighter in weight. Further, the envelope can be made more suitable for mass production.

DETAILED DESCRIPTION OF THE PREFERRED EMBODIMENTS

Some embodiments of the present invention will be described with reference to the accompanying drawings.

Figure 1:
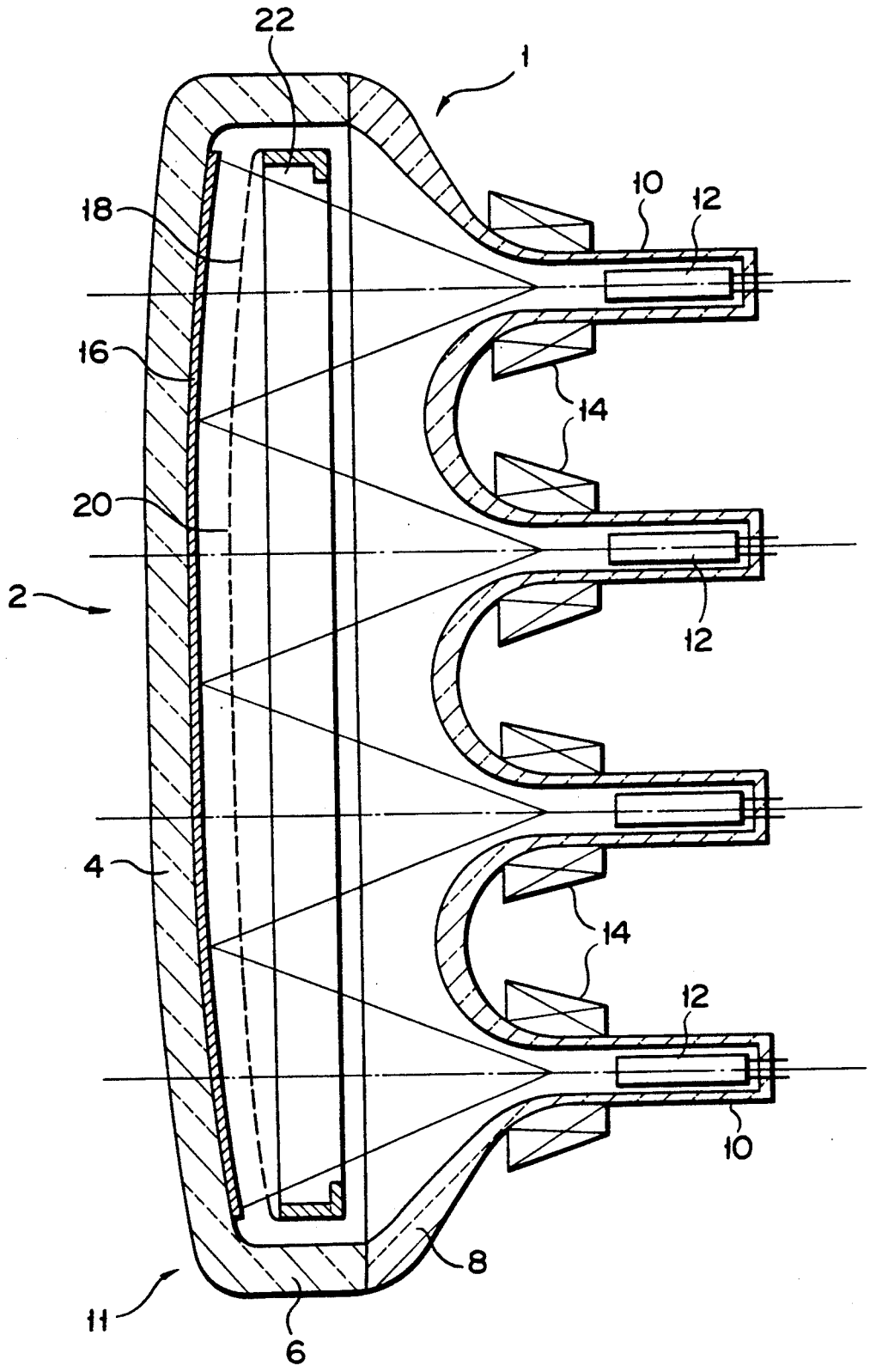
FIG. 1 is a sectional view showing the conventional color cathode ray tube provided with plural neck sections.
Figure 2:
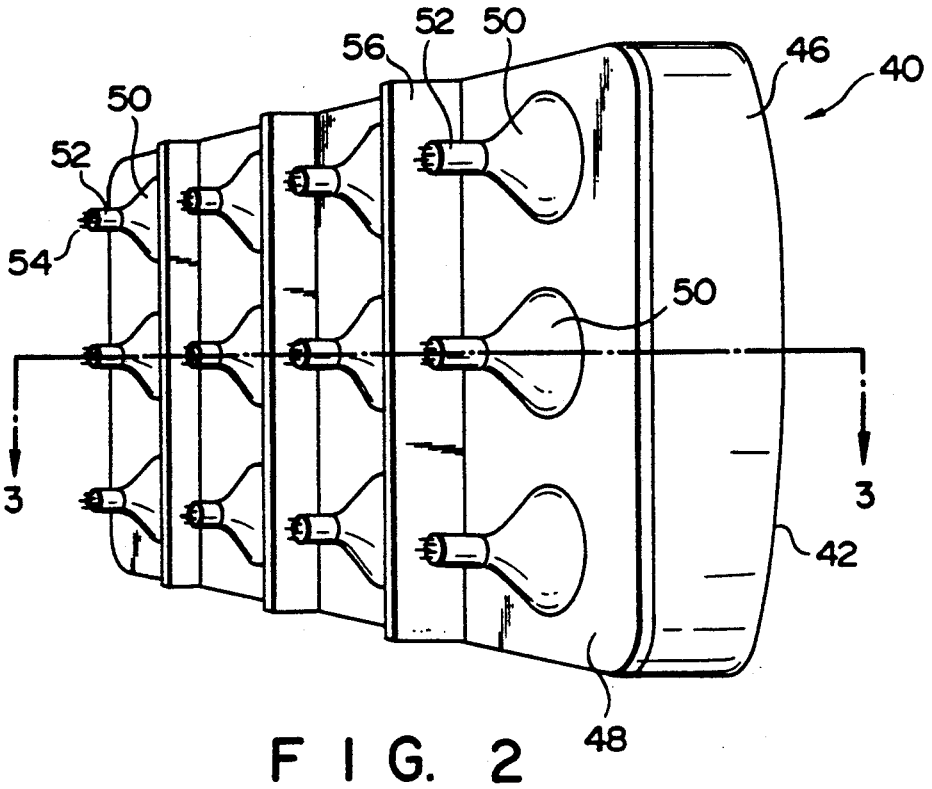
FIG. 2 is a perspective view showing a first example of an envelope according to the present invention.
Figure 3:
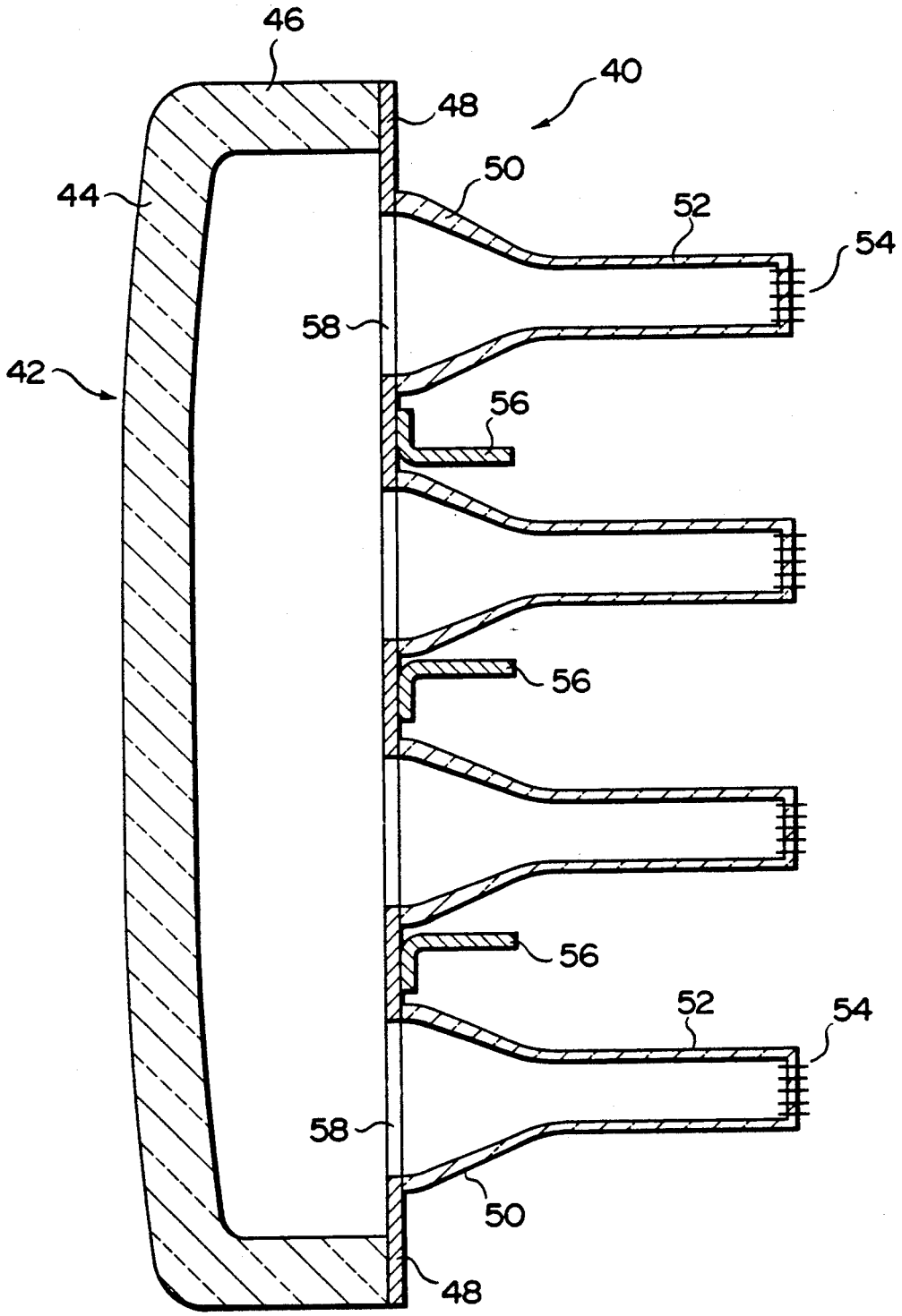
FIG. 3 is a sectional view taken along a line A—A in FIG. 2 to show the envelope in FIG. 2.

A first example of the envelope according to the present invention and having a plurality of necks is shown in FIGS. 2 and 3. This envelope is used for the color cathode ray tube. Envelope 40 comprises panel section 42 provided with substantially rectangular face plate 44 and a skirt 46 extending from the peripheral edge of face plate 44, rear plate 48 (metal connecting means) arranged substantially parallel to face plate 44 and bonded to skirt 46 of panel section 42, a plurality of funnel sections 50 bonded to rear plate 48, and a plurality of neck sections 52, with each neck reaction being continuous from a funnel section 50. The inside of envelope 40 is kept in a vacuum by the panel section 42, rear plate 48, funnel sections 50 and neck sections 52. Each neck section 52 is provided with a plurality of stem pins 54. A plurality of reinforcing plates 56 are attached to the outer face of rear plate 50 to enable rear plate 50 to resist atmospheric pressure.

Figure 4:
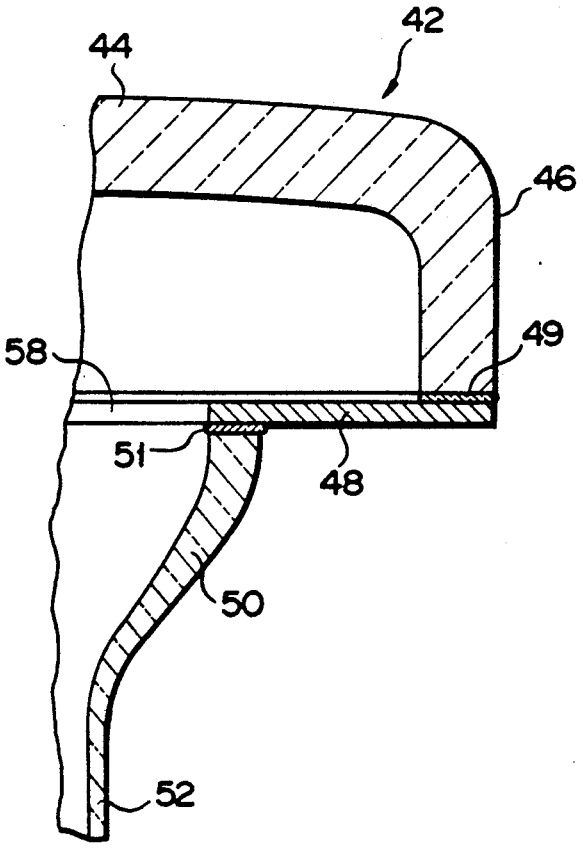
FIG. 4 is an enlarged sectional view showing a portion of the envelope in FIG. 3.

Envelope 40, a portion of which is also shown in FIG. 4, is used for the color cathode ray tube of 20 inches, for example. A phosphor screen, 304.8 mm long and 406.4 mm broad, can be formed on the inner surface of face plate 44 in envelope 40. The length of skirt 46 is 85 mm. Rear plate 48 is made of sealing alloy which includes 50% of nickel, and it is formed like a plate, 2 mm thick. It is perpendicular to the tube axis, it is shaped to match the outer circumference of skirt 46, and it is provided with a plurality of openings 58 each communicating with a corresponding funnel section 50. Skirt 46 and rear plate 48 are bonded to each other with frit glass (for example crystalline lead borate glass) 49 interposed between them. An oxidation layer is formed on that surface area of rear plate 48 to which frit glass 49 is bonded so as to enhance the bonding strength of frit glass 49. The thermal expansion coefficient of the alloy of which rear plate 48 is made is 99.0 ($10^{-7}$/°C.). Twelve funnel sections 50, each of which are separated from the adjacent ones by a certain interval, are bonded to the rear plate 48. Each of twelve openings of the rear plate 48, to which the front side of each funnel section 50 is bonded, is substantially rectangle in shape, 30 mm wide and 25 mm long. Each neck section 52 is continuous from the rear side of each funnel section 50 and has an outer diameter of 22.5 mm. Four neck sections 52 are located in the longitudinal direction of the panel while three neck sections 52 in the lateral direction thereof, totaling to twelve neck sections. Rear plate 48 and each of funnel sections 50 are bonded to each other with frit glass 51 interposed between them. The thermal expansion coefficient of glass, of which the funnel and the neck sections 50 and 52 are made, is 100.0 ($10^{-7}$/°C.). Eight stem pins 54 are projected outside from the end of each of neck sections 52. Each of the plurality of reinforcing plates 56, attached to the outer face of rear plate 48, is made of an L-shaped mild steel. Reinforcing plate 56 is 2.0 mm thick and 20 mm high. These reinforcing plates 56 are spot-welded to rear plate 48.

The envelope having the above-described arrangement enables the skirt and the funnel sections to be surely bonded to the rear plate by the frit glass. The thermal expansion coefficient of the alloy of which the rear plate is made is substantially equal to that of the glass of which the funnel sections are made, thereby preventing distortion caused by heat. The rear plate made of metal is interposed between the panel and each of the funnel sections thereby making it unnecessary to use glass to make the panel continuous to the funnel sections. Although glass can not easily be sharply curved given the characteristic properties of glass, the envelope can be shaped to have sharply-curved-portions when metal is used. The envelope can be thus made shorter in the direction of tube axis. Therefore, the distance between the face plate and the neck sections (or depth of the envelope) can be made shorter than the conventional envelope which is all made of glass. The thickness of the glass in the portion which shifts from the panel to each of the funnel sections is conventionally about the same as that of the panel and is therefore quite large. However, in the present invention, that portion is formed by metal instead of glass and the envelope thus constructed can be made lighter in weight. Further, the funnel sections have no thick portion. This can reduce the thermal distortion of the envelope caused during manufacturing. Furthermore, the panel, rear plate, funnel and neck sections can be made independently of the others. This can make the manufacturing cost lower and make the envelope more suitable for mass production.

The rear plate of this embodiment is made of the above-mentioned sealing alloy which contains 50% of nickel. In addition, it may be made of sealing alloy which contains 52% of nickel and 6% of chrome. It is formed in a generally planar plate, but it may be shaped to match the curvature of the face plate. The reinforcing plate which is spot-welded to the outer face of the rear plate is L-shaped, but when one of other welding manners such as arc or plasma welding is employed, it is not necessary that the reinforcing plates are L-shaped. When the rear plate is made 5 mm thick, for example, the envelope can resist atmospheric pressure, thereby making it unnecessary to use the reinforcing plates.

Figure 5:
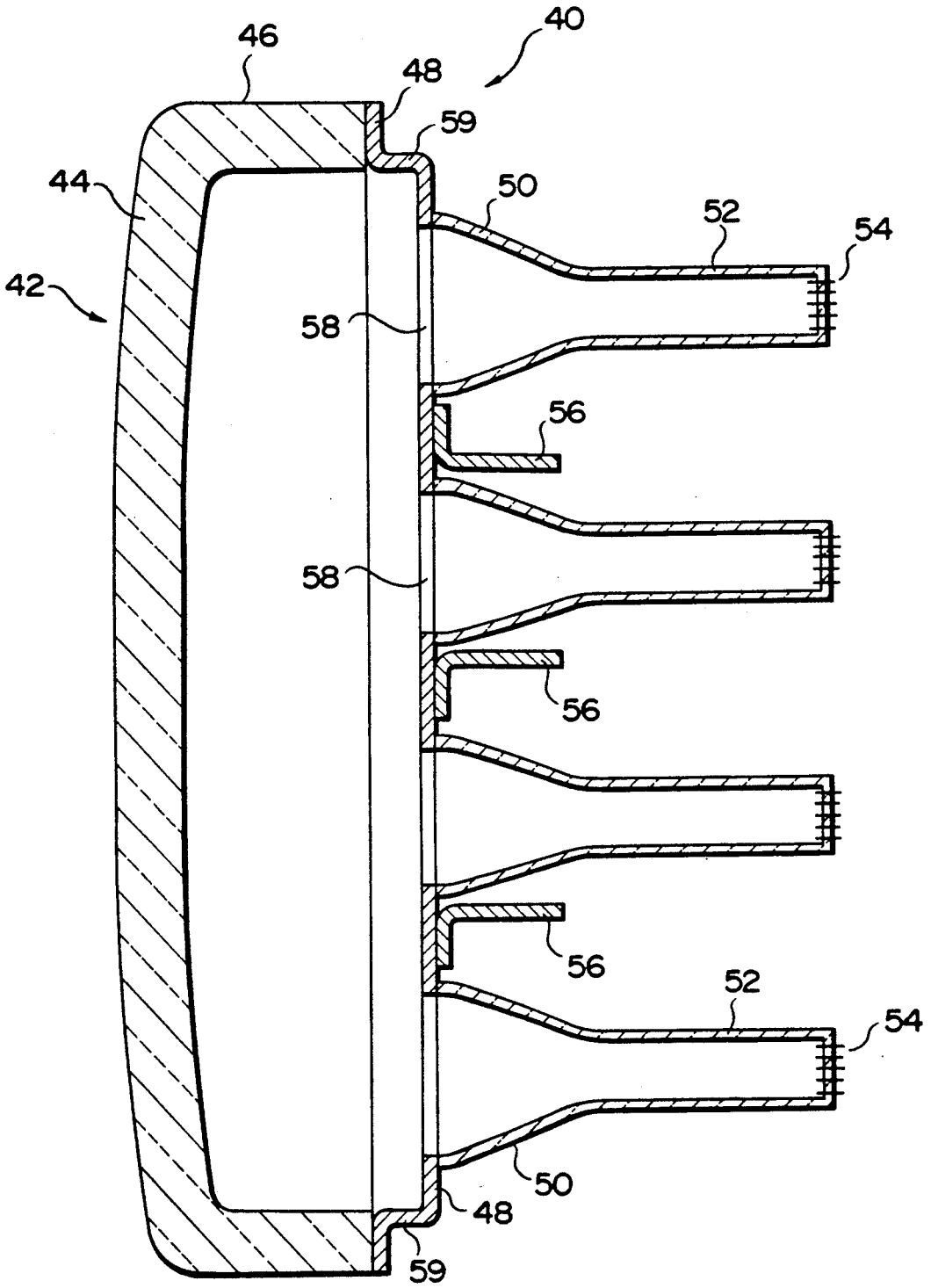
FIG. 5 is a sectional view showing a variation of the first embodiment.

FIG. 5 shows a variation of the envelope in which the rear plate is different in shape from the one used in the first embodiment of the present invention. The other components of the envelope are same except the shape of this rear plate. Therefore, description on these same components will be omitted. Step 59 is formed between this peripheral rim portion of rear plate 58 which is bonded to skirt 46 and that portion thereof which is bonded to funnel sections 50. This step 59 is intended to further separate funnel sections 50 from the face plate 44. When the rear plate 58 is provided with this step 59, it can be made strong enough to resist atmospheric pressure, as compared with the case where it is formed like a plate. This variation can achieve the same merits as those attained by the first example of the envelope. This first example of the envelope and its variation can be applied to various kinds of the cathode ray tubes.

Figure 6:
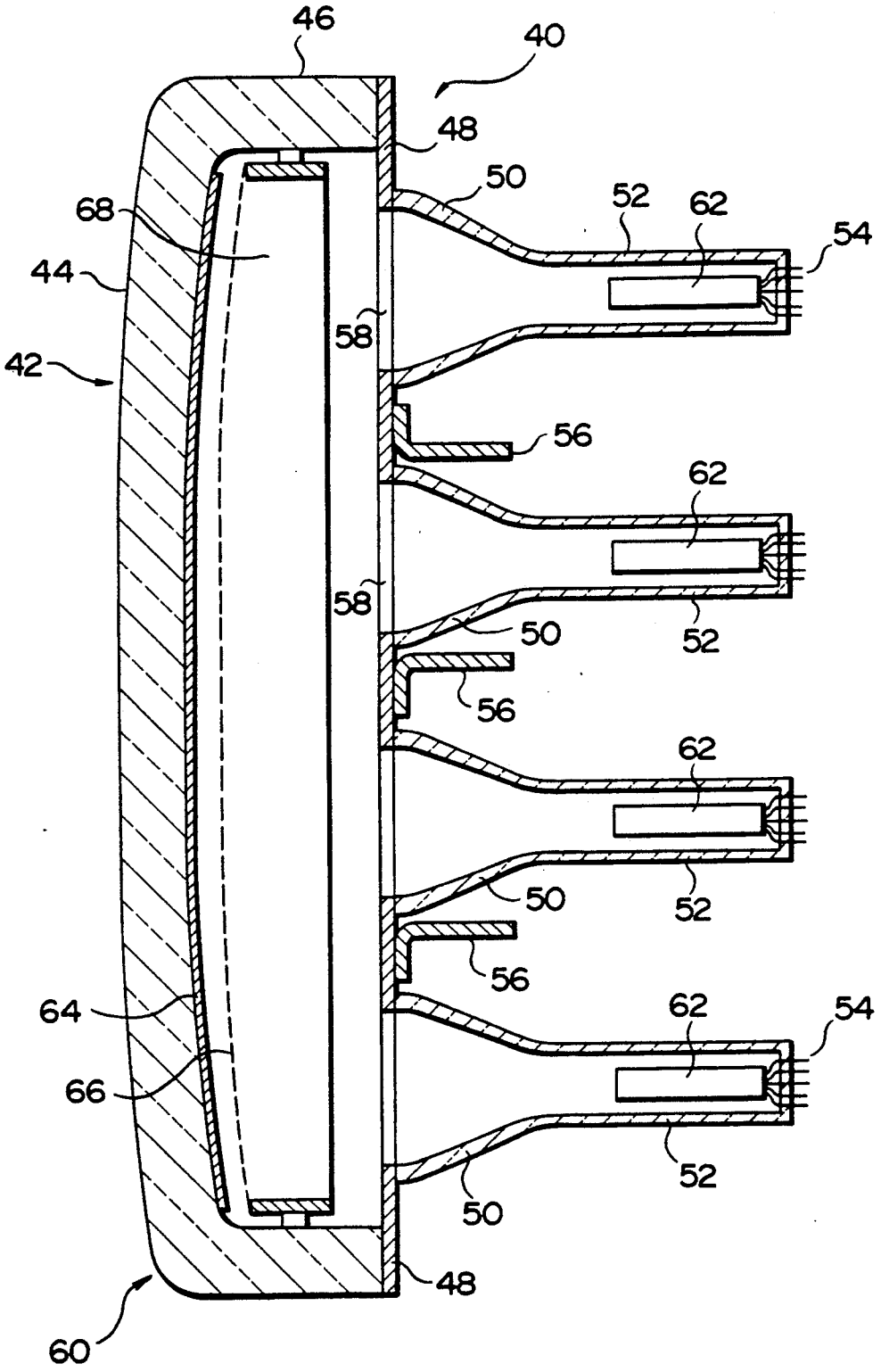
FIG. 6 is a sectional view showing a color cathode ray tube in which the first example of the envelope is employed.
Figure 7:
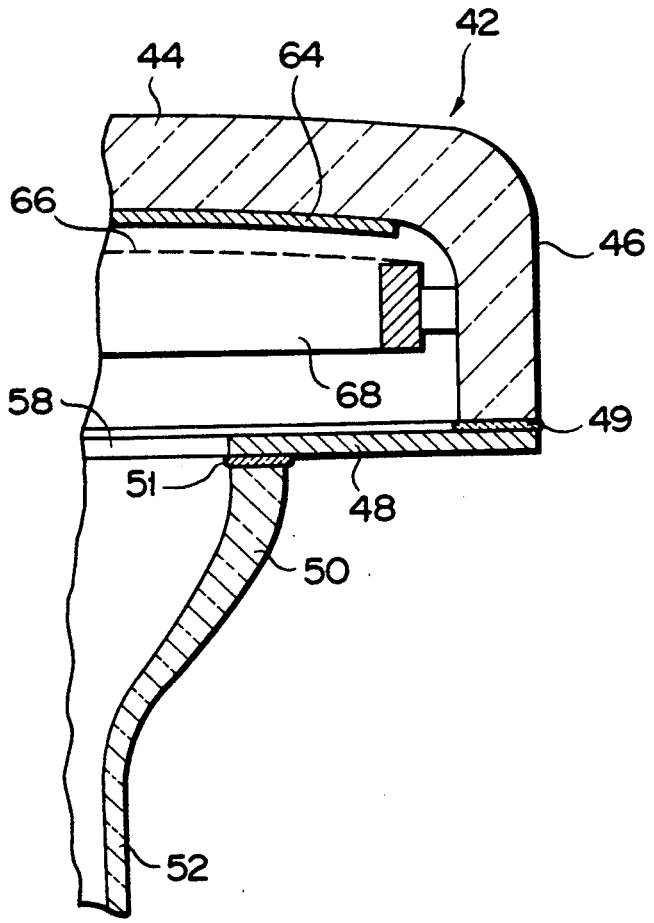
FIG. 7 is an enlarged sectional view showing a portion of the tube in FIG. 6.

A color cathode ray tube in which the above-described envelope is employed is shown in FIGS. 6 and 7. Envelope 40 for this color cathode ray tube 60 comprises panel section 42 provided with substantially rectangular face plate 44 and skirt 46 extending from the peripheral edge of the face plate 44, rear plate 48 arranged substantially parallel to the face plate 44 and bonded to the skirt 46 of the panel section 42, a plurality of funnel sections 50 are bonded to the rear plate 48, and a like plurality of neck sections 52 depend from one of the corresponding funnel sections 50. The inside of envelope 40 is kept in a vacuum by panel section 42, rear plate 48, and the funnel and neck sections 50 and 52. Each of the plurality of neck sections 52 is provided with a plurality of stem pins 54. A plurality of reinforcing plates 56 are attached to the outer face of rear plate 48.

Twelve electron guns 62 are housed in the plurality of neck sections 52, respectively, in the case of this color cathode ray tube 60. Stem pins 54 are connected to each of the electron guns 62. The phosphor screen 64 is formed on the inner surface of face plate 44. Three electron beams shot from each of electron guns 62 are directed onto the phosphor screen 64 to emit three colors of red, green and blue. The shadow mask 66 is located in envelope 40 to face phosphor screen 64 and is provided with a plurality of apertures. Mask frame 68 is attached to the circumferential rim of shadow mask 66 and kept supported in panel section 42.

In the case of the color cathode ray tube of 20 inches, for example, phosphor screen 64, 304.8 mm long and 406.4 mm broad, is formed on the inner surface of face plate 44. Skirt 46 is made 85 mm long. Rear plate 48 is made of sealing alloy which contains 50% nickel and it is formed like a plate having a thickness of 2 mm. It is perpendicular to the tube axis, shaped to match the circumferential contour of skirt 46 and is provided with a plurality of openings 58 each communicating with a corresponding funnel section 50. Skirt 46 and rear plate 48 are bonded to each other with frit glass (for example crystalline lead borate glass) interposed between them. That surface area of rear plate 48 to which frit glass 49 is bonded has an oxidation layer formed thereon to enhance the bonding strength of frit glass 49. Thermal expansion coefficient of the alloy of which rear plate 48 is made is 99.0 ($10^{-7}$/°C.). Each of the front sides of funnel sections 50 which is bonded to rear plate 48 is formed in a substantially rectangle shape having a length of 30 mm and a width of 25 mm. The rear side of each of the neck sections 52 has an outer diameter of 22.5 mm and is formed continuous with its corresponding funnel section 50. Four neck sections 52 are arranged in the longitudinal direction of the panel section while three neck sections 52 in the lateral direction thereof, totaling twelve neck sections 52. Rear plate 48 and each of the funnel sections 50 are bonded to each other with frit glass 51 interposed between them. Thermal expansion coefficient of the glass of which funnel and neck sections 50 and 52 are made is 100.0 ($10^{-7}$/°C.). Eight stem pins project outside from the end of each of neck sections 52. Each of the reinforcing plates 56 attached to the outer face of rear plate 48 is made by an L-shaped soft steel plate. Reinforcing plate 56 is made 2.0 mm thick and 20 mm high. Reinforcing plates 56 are spot-welded to rear plate 48.

Color cathode ray tube 60 having the above-described arrangement includes twelve electron guns 62. These electron guns 62 shoot electron beams relative to their respective areas on the phosphor screen. Namely, the phosphor screen is divided into twelve areas, each of which is shot by its corresponding electron gun. The phosphor screen emits three colors of red, green and blue at its respective areas responsive to the electron beams shot by the electron guns.

In the case of the above-described color cathode ray tube, the area of the phosphor screen which is scanned by one electron gun is quite small, as compared with the screen area covered by each electron gun in conventional color cathode ray tubes. The electron beams shot by the electron guns can thus travel a shorter distance to reach the phosphor screen thereby reducing the possibility of causing the electron beams to wrongly land onto the phosphor screen. As the result, the picture equality of this color cathode ray tube can be kept extremely high. According to the color cathode ray tube of the present invention, the skirt and the funnel sections can be reliably bonded to the rear plate by the frit glass. In addition, the thermal expansion coefficient of the alloy of which the rear plate is made is substantially same as that of the glass of which each of the funnel sections are made. This prevents the envelope from being distorted by heat. In the case of the above-described color cathode ray tube according to the present invention, the metal rear plate is arranged between the panel section and each of the funnel sections. It is therefore not necessary that glass be used to form connection between them. Glass could not be made as sharply-curved because of its characteristic properties. When metal is employed, however, the envelope can be shaped to have sharply-curved portions. The length of the color cathode ray tube can thus be made shorter in the direction of its tube axis. Therefore, the distance between the face plate and the neck sections (or depth of the color cathode ray tube) can be made shorter, as compared with the conventional envelope which was all made of glass. That portion of glass which shifts from the panel section to each of the funnel sections was substantially same in thickness as the panel section and was quite thick in the case of the conventional envelope. This portion of glass can now be replaced by a thin metal plate, thereby making the color cathode ray tube lighter in weight. Further, it is not necessary to make the funnel section thick at any portion, thereby reducing the thermal distortion of the envelope caused in the manufacturing course. Furthermore, the panel section, rear plate, funnel and neck sections can be made independently of the others and then assembled to make the color cathode ray tube. This can make the manufacturing cost lower. In addition, the color cathode ray tube can be made more suitable for mass production.

Figure 8:
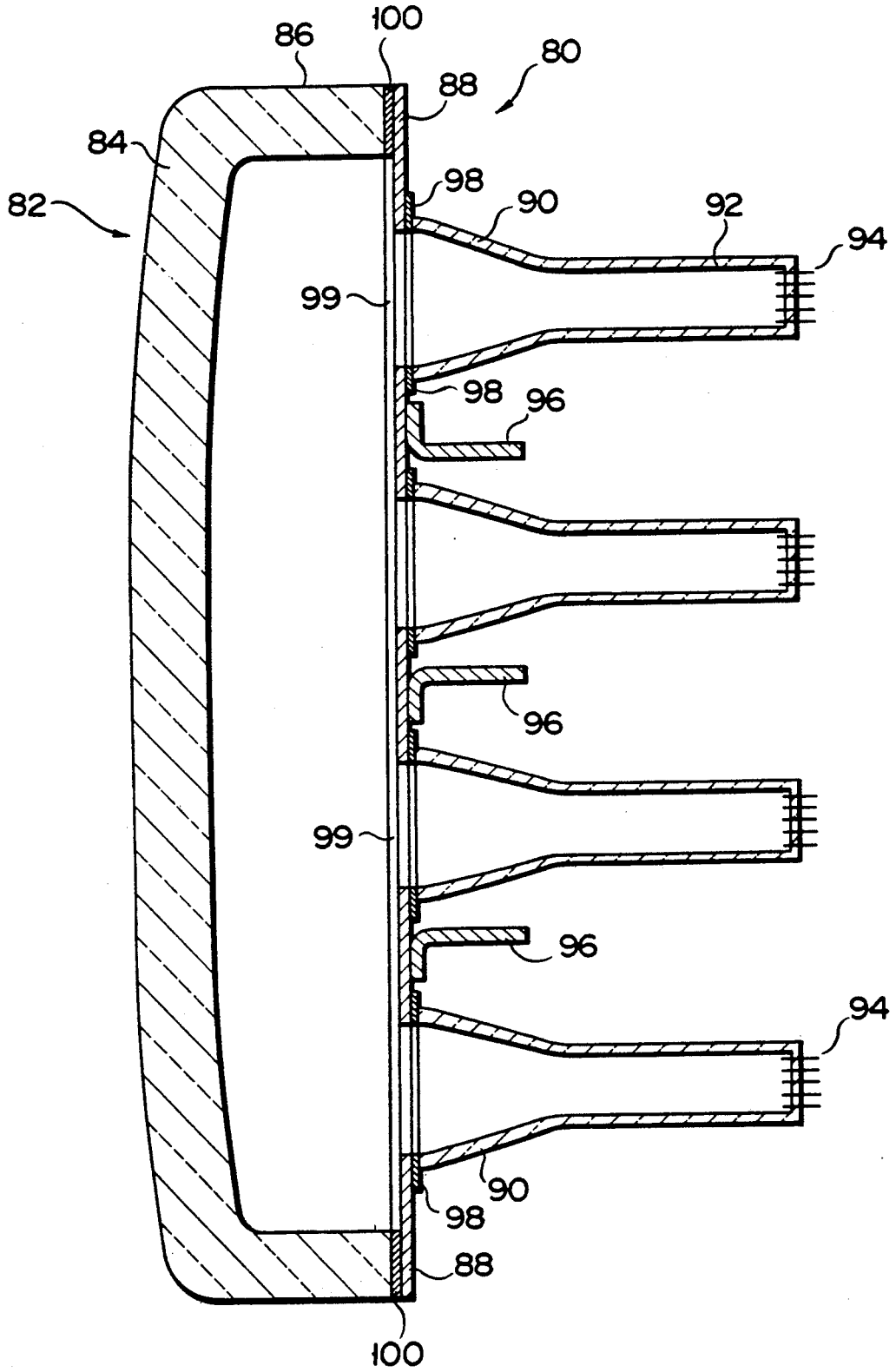
FIG. 8 is a sectional view showing an envelope of a second embodiment according to the present invention.

A second example of the envelope according to the present invention is shown in FIG. 8. The envelope 80 is intended for use in cathode ray tubes. Envelope 80 comprises a panel section 82 having a substantially rectangular face plate 84 and a skirt 86 extending from the peripheral edge of the face plate 84, a rear plate 88 arranged substantially parallel to the face plate 84 and bonded to the skirt 86 of panel section 82, a plurality of funnel sections 90 bonded to the rear plate 88, and a neck sections 92 depending from and continuous with each of the corresponding funnel sections 90. The inside of the envelope 80 is kept in a vacuum by a panel section 82, a rear plate 88, a plurality of funnel and neck sections 90 and 92. Each of the plurality of neck sections 92 is provided with a plurality of stem pins 94. The plurality of reinforcing plates 96 are attached to the outer face of the rear plate 88. A first thin metal plate 98, which is a first insertion means, is interposed between the rear plate 88 and each of the funnel sections 90. A second thin metal plate 100, which is a second insertion means, is interposed between the rear plate 88 and the skirt 86.

Figure 9:
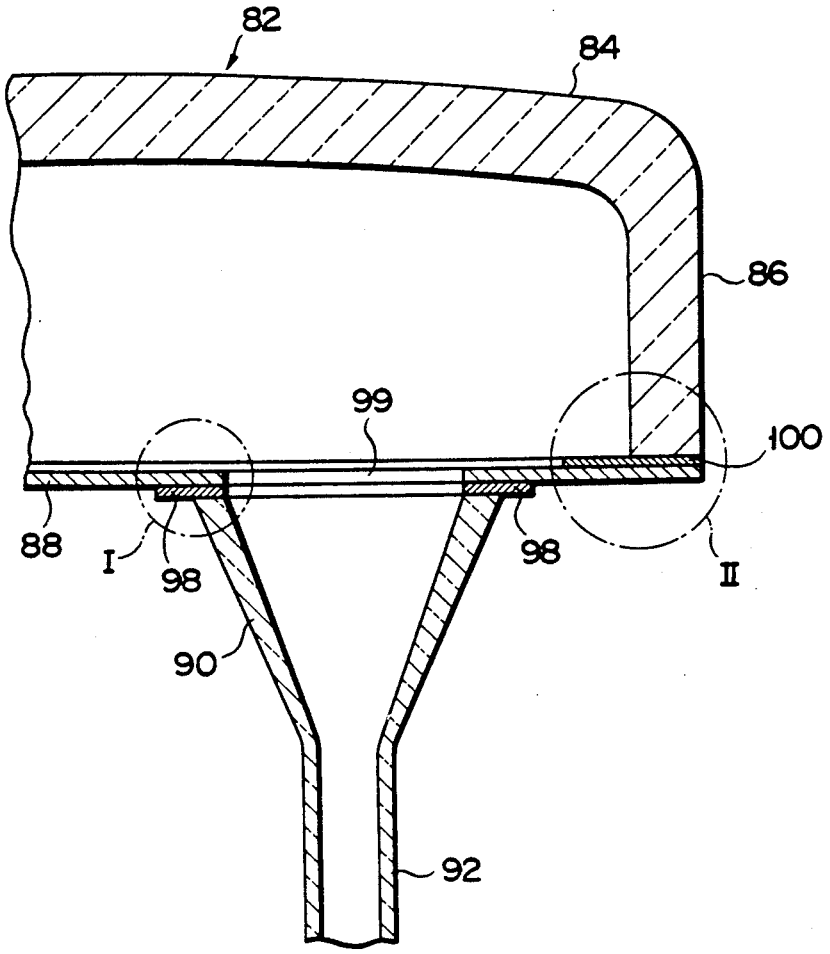
FIG. 9 is an enlarged sectional view showing a portion of the envelope in FIG. 8.
Figure 10A:
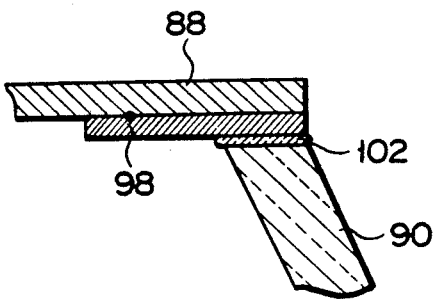
FIG. 10A is an enlarged sectional view showing a portion I in FIG. 9.
Figure 10B:
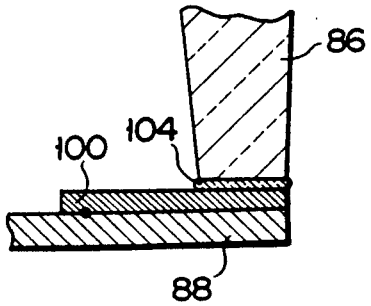
FIG. 10B is an enlarged sectional view showing a portion II in FIG. 9.

This envelope is intended for use in color cathode ray tubes of 20 inches, for example. A phosphor screen, 304.8 mm long and 406.4 mm broad, can be formed on the inner surface of face plate 84 in the case of envelope 80. Skirt 86 is made 85 mm long. Rear plate 88 is made of mild steel and shaped like a plate having a thickness of 2 mm. The thermal expansion coefficient of the mild steel of which rear plate 88 is made is 140 ($10^{-7}$/°C.) It is perpendicular to the tube axis, is made to match the circumferential contour of skirt 86, and is provided with a plurality of openings 99 each communicating with one of the corresponding funnel sections 90. As shown in FIGS. 9 and 10B, a second thin metal plate 100, 0.3 mm thick and 20 mm wide, made of 50% nickel alloy and shaped like a hollow disk, is interposed between the skirt 86 and the rear plate 88, and is bonded to the rear plate 88. Frit glass (for example crystalline lead borate glass) 104 is interposed between the second thin metal plate 100 and the skirt 86. An oxidation layer is formed on the surface of second thin metal plate 100 to enhance the bonding strength of frit glass 104. The thermal expansion coefficient of the alloy of which second insertion means is made is 99.0 ($10^{-7}$/°C.) Twelve funnel sections 90 are bonded to the rear plate 88 through the insertion members and each of the front sides of the rear plate 88 is shaped in a substantially rectangle form having a diagonal line of about 40 mm. Each of the rear sides of the neck sections 92, which has an outer diameter of 22.5 mm, is made to depend from and to be continuous with a corresponding funnel section 90. As shown in FIG. 10A, a first thin metal plate 98, 0.3 mm thick and 5 mm wide, made of 50% nickel alloy and shaped like a hollow disk is interposed between the rear plate 88 and each of the funnel sections 90 and there bonded to the rear plate 88. Frit glass 102 is interposed between the first thin metal plate 98 and each of the funnel sections 90. The thermal expansion coefficient of the glass which the funnel neck sections 90 and 92 are made is 100.0 ($10^{-7}$/°C.). Eight stem pins 94 project from the end of each of the neck sections 92. Four neck sections are arranged in the longitudinal direction of panel section 82 while three neck sections are arranged in the lateral direction thereof, totaling twelve neck sections. Each of the reinforcing plates 96 attach to the outer face of the rear plate 88 and is made of an L-shaped soft steel plate. It is 2.0 mm thick and 200 mm high and it is spot-welded to rear plate 88.

It will now be described how the above-mentioned members are bonded to one another. Bonding between the thin metal plates, which serve as the first and second insertion means, and the funnel sections, which are made of glass, is attained by frit glass. Frit glass is baked at about 450° C. for an hour to enable the metal plates and glass to be bonded to each other. The thermal coefficients of expansion of the metal plate and glass thus bonded are 99.0 ($10^{-7}$/°C.) in the case of the insertion means and 100.0 ($10^{-7}$/°C.) in the case of the glass of which the funnel sections are made. As a result, almost no distortion is left in both the metal plate and the glass being bonded. Seam welding is used to obtain the metal to metal bonds. Bonding between the rear plate which is made of metal and the thin metal plates, which serves as the insertion means, is attained by seam welding. The welded portions are separated as remotely as possible from the frit glass bonded portions. This is because these bonded portions are deformed by the heat of the welding process and could cause the glass seals to peel off from the bonded portions.

According the envelope having the above-described arrangement, the rear plate and the skirt, as well as the rear plate and each of the funnel sections, can be reliably bonded to each other by frit glass and thin metal plates. The thermal expansion coefficient of the alloy of which the first and second thin metal plates are made is substantially equal to that of the glass of which each of the funnel sections are made, thereby preventing the envelope from being distorted by heat. In this embodiment, the same advantage as the first embodiment can be obtained. Moreover, since the first and second insertion means are made of a sealing alloy and the rear plate is made of mild steel, the glass, the sealing alloy, the mild steel, the sealing alloy, and the glass can be bonded in the order listed, respectively. Therefore, the amount of expensive sealing alloy to be expended can be minimized. Since the rear plate can be made of mild steel, the envelope can be composed easily.

Although seam welding has been used to weld metal to metal, other welding manners such as plasma, laser and ultrasonic weldings may also be used.

Figure 11:
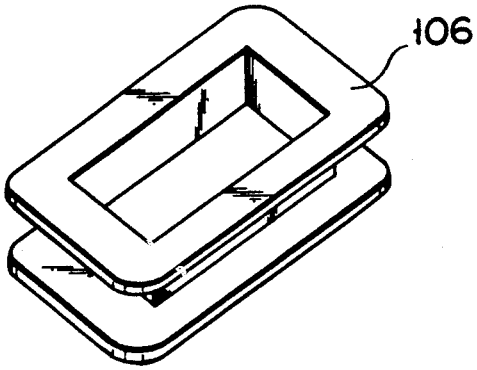
FIG. 11 is a perspective view showing a first variation of the first insertion members.
Figure 12:
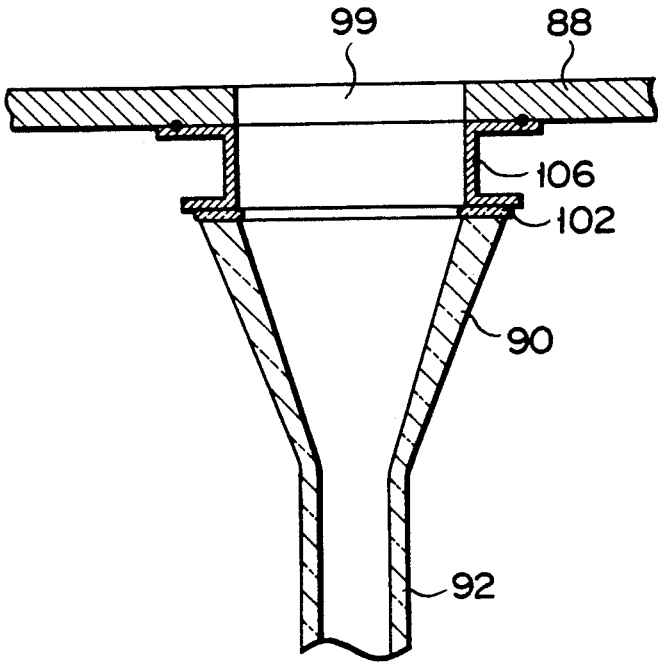
FIG. 12 is a sectional view showing the first variation of the first insertion members.

FIGS. 11 through 16 show other first insertion means which have various kinds of shapes. A first variation of the first insertion means is shown in FIGS. 11 and 12. This first insertion means 106 is made of sealing alloy which is 50% comprised of nickel. Insertion means 106 includes a substantially cylindrical portion and two disk or flange portions projecting outwardly and horizontally from both ends of the cylindrical portion. Outer faces of these disk portions are bonded to the frit glass 102 and rear plate 88.

Figure 13:
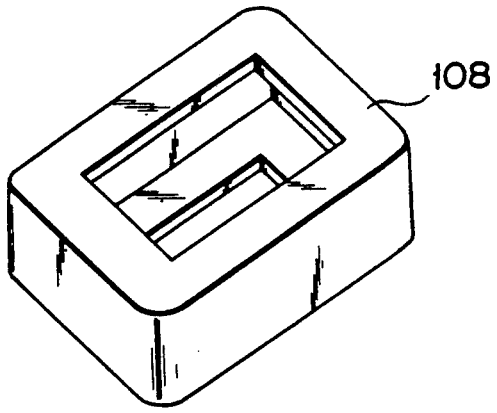
FIG. 13 is a perspective view showing a second variation of the first insertion members.
Figure 14:
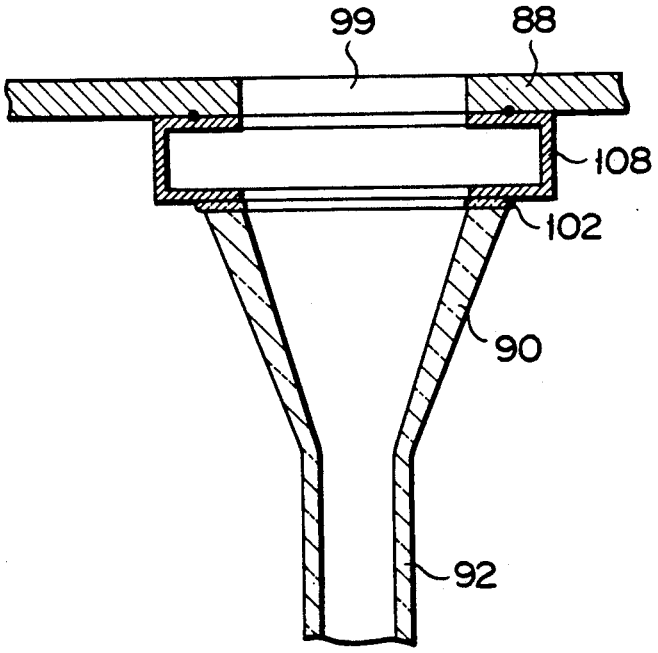
FIG. 14 is a sectional view showing the second variation of the first insertion members.

A second variation of the first insertion means is shown in FIGS. 13 and 14. This insertion means 108 is made of sealing alloy which contains 50% nickel. Insertion means 108 includes a substantially cylindrical portion and two disk or flange portions projecting inwardly and horizontally from both ends of the cylindrical portion. Outer faces of these disk portions are bonded to the frit glass 102 and the rear plate 88, respectively.

Figure 15:
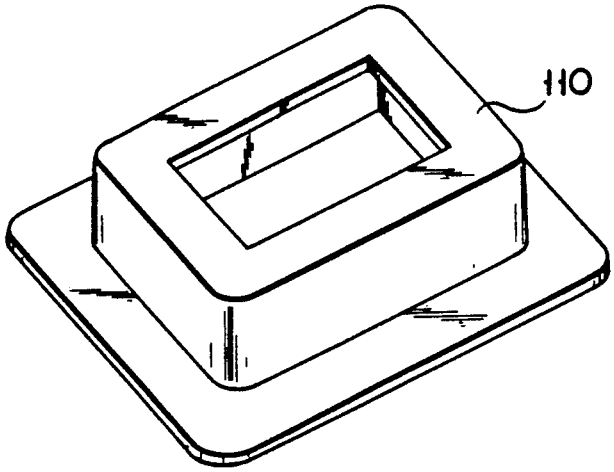
FIG. 15 is a perspective view showing a third variation of the first insertion members.
Figure 16:
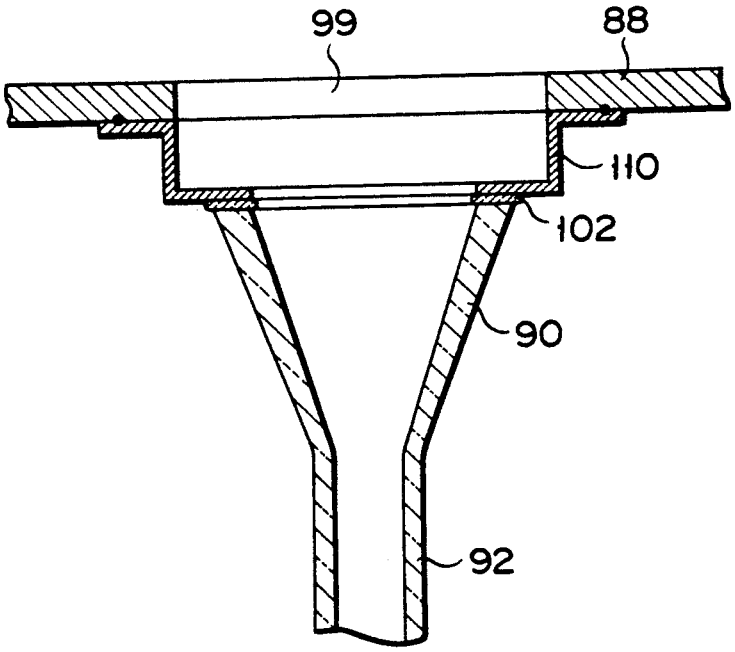
FIG. 16 is a sectional view showing the third variation of the first insertion members.

A third variation of the first insertion means is shown in FIGS. 15 and 16. This insertion means 110 is made of sealing alloy which contains 50% nickel. Insertion means 110 includes a substantially cylindrical portion and two disk or flange portions, one of which projects inward and horizontally from one end of the cylindrical portion while the other of which projects outwardly and horizontally from the other end thereof. The outer face of the inward projecting disk portion is bonded to frit glass 102 while that of the outward projecting disk portion to rear plate 88.

When the first through third variations of the first insertion means are employed, the rear plate can be spaced further from each of the funnel sections, as compared with the case where a metal plate 98 is used. Therefore, the portions bonded by the frit glass can be protected better from the heat caused by welding the rear plate to the insertion means.

The first and second insertion means have been described as being made of alloy which contains 50% nickel, but they may also be made of other alloy which contains 52% nickel and 6% chrome.

This rear plate has been described as being made like a plate, but it may also be curved so as to have the same curvature as the face plate.

Figure 17:
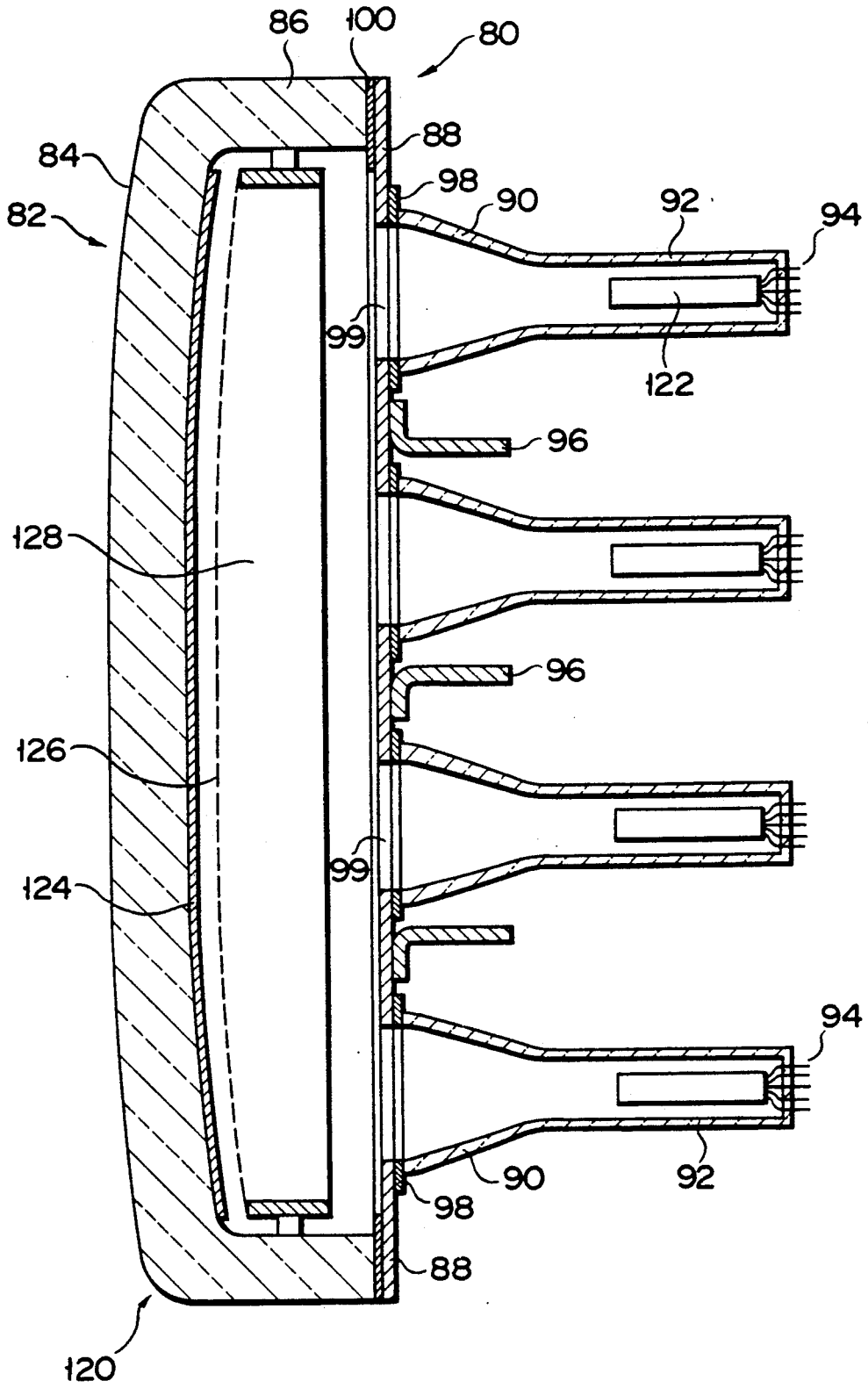
FIG. 17 is a sectional view showing a color cathode ray tube in which the envelope of the second embodiment is employed.
Figure 18:
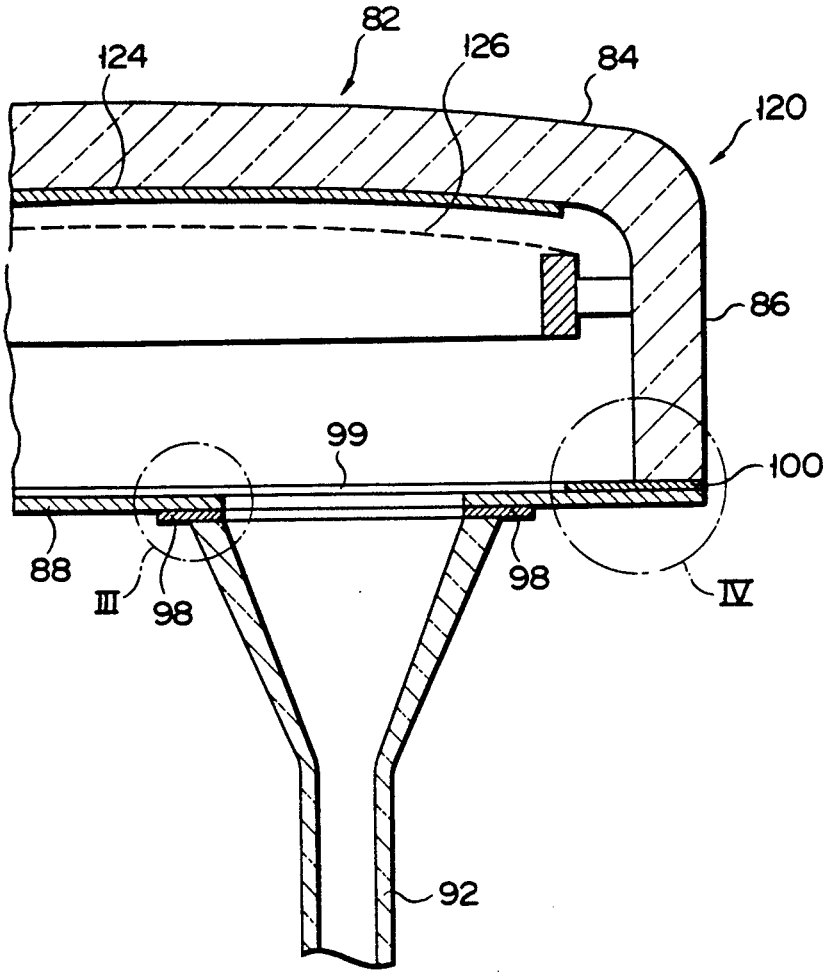
FIG. 18 is an enlarged sectional view showing a portion of the tube in FIG. 17.
Figure 19A:
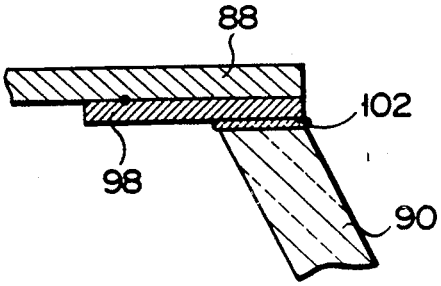
FIG. 19A is an enlarged sectional view showing a portion III in FIG. 18.
Figure 19B:
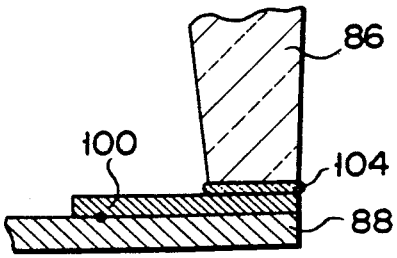
FIG. 19B is an enlarged sectional view showing a portion IV in FIG. 18.

A color cathode ray tube which uses the above-described envelope is shown in FIGS. 17 through 19. Envelope 80 for this color cathode ray tube 120 comprises panel section 82, provided with substantially rectangular face plate 84, and a skirt 86, extending from the peripheral edge of face plate 84, a rear plate 88 arranged substantially parallel to the face plate 84 and bonded to the skirt 86 of panel section 82, a plurality of funnel sections 90 bonded to rear plate 88, and a like plurality of neck sections 92 each depending from and being with a continuous corresponding funnel section 90. The inside of envelope 80 is kept in a vacuum by the panel section 82, the rear plate 88, and the funnel and neck sections 90 and 92. Each of the plurality of neck sections 92 is provided with a plurality of stem pins 94. A plurality of reinforcing plates 96 are attached to the outer face of the rear plate 88. The first thin metal plate 98, which serves as the first insertion means, is interposed between the rear plate 88 and each of the funnel sections 90 to provide bonding between them. A second thin metal plate 100, which serves as the second insertion means, is interposed between rear plate 88 and skirt 86 to provide bonding between them.

An electron gun 122 is housed in each of the plurality of neck sections 92. Stem pins 94 are connected to each of electron guns 122. A phosphor screen 124 is formed on the inner surface of the face plate 84. The phosphor screen 124 is struck by electron beams shot from each of electron guns 122, so as to emit the three colors of red, green and blue. The shadow mask 126 is located in the envelope 80 to face the phosphor screen 124. The shadow mask 126 is provided with a plurality of apertures. The mask frame 128 encloses the shadow mask 126, and is in turn supported by the panel section 82.

In the case of the 20-inch color cathode ray tube, for example, a phosphor screen, 304.8 mm long and 406.4 mm broad, is formed on the inner face of face plate 124. Skirt 86 is made 85 mm long. The rear plate 88 is made of mild steel and is shaped like a plate having a thickness of 2 mm. The thermal expansion coefficient of the mild steel, of which rear plate 88 is made, is 140 ($10^{-7}$/°C.).

The rear plate is dispersed perpendicular to the tube axis, is made to match the circumferential contour of skirt 86, and it is provided with a plurality of openings 98 each communicating with a corresponding funnel section 90. A second thin metal plate 100, 0.3 mm thick and 200 mm wide, shaped like a hollow disk and made of 50% nickel alloy, is interposed between the skirt 86 and the rear plate 88 and bonded to rear plate 88. Frit glass (for example crystalline lead borate glass) 104 is interposed between the second thin metal plate 100 and the skirt 86. An oxidation layer is formed on that surface area of second thin metal plate 100 to which frit glass 104 is to be bonded so as to strengthen the bonding ability of the frit glass 104. The thermal expansion coefficient of the alloy, of which second thin metal plate 100 is made, is 99.0 ($10^{-7}$/°C.). The front side of each of the funnel sections 90, which is to be bonded to rear plate 88 through the insertion means, is formed so as to be substantially rectangular having a diagonal line of about 40 mm. The rear side of each neck section 92, which has an outer diameter of 22.5 mm, is made continuous with the corresponding funnel section it depends from 90. The first thin metal plate 98, 0.3 mm thick and 5 mm wide, shaped like a hollow disk and made of alloy which contains 50% nickel, is interposed between the rear plate 88 and each of the funnel sections and is bonded to the rear plate 88. Frit glass 102 is interposed between the first thin metal plate 98 and each of the funnel sections 90. An oxidation layer is formed on that surface area of the first thin metal plate 98 to which frit glass 102 is to be bonded so as to strengthen the bonding ability of frit glass 102. The thermal expansion coefficient of the glass, of which funnel and neck sections 90 and 92 are made, is 100.0 ($10^{-7}$/°C.). Eight stem pins 94 project outside from the end of each of the neck sections 92. Each of reinforcing plates 96 is made by an L-shaped soft steel plate. It is 2.0 mm thick and 20 mm high and is spot-welded to the rear plate 88.

The color cathode ray tube having the above-described arrangement includes twelve electron guns 122. Each of these electron guns 122 shoots electron beams to emit three colors of red, green and blue at the corresponding area of the phosphor screen. More specifically, the phosphor screen is divided into twelve areas which correspond to the twelve electron guns. The phosphor screen emits three colors red, green and blue, responsive to the electron beams shot from each of the electron guns.

In the case of the above-described color cathode ray tube, that area of the phosphor screen which is scanned by one electron gun is quite small, by comparison with the conventional color cathode ray tube. Therefore, the electron beams shot from each of the electron guns travels shorter distance to reach the phosphor screen, and thereby reduces the possibility of causing the electron beams to wrongly on the phosphor screen. As a result, the picture quality of the color cathode ray tube can be remarkably enhanced.

It will be described how the above-mentioned components are bonded to one another. Frit glass is used to attain bonding between the first and second thin metal plates which serve as the first and second insertion means and the glass of which the funnel sections are made. Frit glass is baked at about 450° C. for an hour to establish bonding between the thin metal plates and the glass. The thermal expansion coefficients of the thin metal plates and the glass thus bonded are 99.0 ($10^{-7}$/°C.), in the case of the insertion means, and 100.0 ($10^{-7}$/°C.) in the case of the glass of which the funnel sections are made. Therefore, no distortion is left in both the thin metal plates and the glass bonded. An oxidation layer is formed on each of those areas of the thin metal plates to which frit glass is to be bonded so as to strengthen the bonding ability of the frit glass. Seam welding is used to connect metal to metal. Resistance seam welding is used to attain bonding between the rear plate made of metal and the thin metal plates which serve as the insertion means. Welded portions are spaced apart from those portions which are bonded by frit glass so as to prevent the frit-glass-bonded portions from being deformed by the heat caused by the welding process or the frit seals from being peeled off from these bonded portions.

According to the color cathode ray tube as described above, the rear plate and the skirt, as well as the rear plate and the funnel sections, can be reliably connected to each other by the frit glass and the thin metal plates. The thermal expansion coefficient of the alloy of which the insertion means is made is substantially the same as that of the glass of which the funnel sections are made. This avoids the envelope from being distorted by heat.

Although seam welding has been used to weld metal to metal, one of other welding manners such as plasma, laser and ultrasonic weldings may be employed.

Although the first and second insertion members have been described as being made of a 50% nickel alloy, they may also be made of another alloy which contains 52% of nickel and 6% chrome. Various kinds of variations which have been mentioned as the first insertion means to describe the envelopes of the present invention may be used.

The rear plate has been shaped like a plate, but it may be curved to have same curvature as that of the face plate. Each of the reinforcing members is L-shaped, but when one of other welding manners such as arc and plasma weldings is employed, it is unnecessary to make the reinforcing members L-shaped. When the rear plate is made 5 mm thick, no reinforcing member is needed. This is because no reinforcing member is needed when the rear plate is made thick enough to resist atmospheric pressure.

We claim:

1. A vacuum envelope for a cathode ray tube comprising:

a plurality of funnel sections each having a front and a rear side respectively;

a plurality of neck sections, one neck section being arranged on each rear side of the funnel sections;

a panel section including a face plate having an inner surface, and a skirt extending from a peripheral edge of the face plate; and a metal connecting means for connecting each front side of the funnel sections to the skirt of the panel section, the metal connecting means having a main surface substantially parallel to the inner surface of the face plate an outer surface, and a plurality of openings on the main surface corresponding to the front side of each of the funnel sections.

2. The envelope according to claim 1, wherein a plurality of reinforcing members are attached to the outer face of said metal connecting means, said plurality of reinforcing members serving to resist atmospheric pressure.

3. The envelope according to claim 1, wherein said metal connecting means has a curvature which is the same as a curvature of the face plate, said metal connecting means is separated from the face plate by a certain distance and is arranged perpendicular to the tube axis.

4. The envelope according to claim 1, wherein said metal connecting means has a step between a first portion of said metal connecting means which is bonded to the skirt and a second portion of said connecting means which is bonded to the funnel sections, said second portion which is bonded to the funnel sections is spaced farther from the face plate than said first portion which is bonded to the skirt.

5. A vacuum envelope for a cathode ray tube comprising:

a plurality of funnel sections each having a front and a rear side respectively;

a plurality of neck sections, one neck section being arranged on each rear side of the funnel sections;

a panel section including a face plate having an inner surface, and a skirt extending from a peripheral edge of the face plate;

a metal connecting means for connecting each front side of the funnel sections to the skirt of the panel section, the metal connecting means having a main surface substantially parallel to the inner surface of the face plate, an outer surface, and a plurality of openings corresponding to the front side of each of the funnel sections;

a plurality of first insertion means for insertion between each of the funnel sections and the metal connecting means, said plurality of first insertion means having a thermal expansion coefficient lower than a thermal expansion coefficient of the metal connecting means; and a plurality of second insertion means for insertion between the skirt of the panel section and the metal connecting means, said plurality of second insertion means having a thermal expansion coefficient lower than that of the metal connecting means.

6. The envelope according to claim 5, wherein a plurality of reinforcing members are attached to the outer face of said metal connecting means, said plurality of reinforcing members serving to resist atmospheric pressure.

7. The envelope according to claim 5, wherein said metal connecting means has a curvature which is the same as a curvature of the face plate, said metal connecting means is separated from the face plate by a certain distance, and is arranged perpendicular to the tube axis.

8. The envelope according to claim 5, wherein each of said first insertion means has a cylindrical portion including two ends thereof, and one disk portion projecting outward and horizontally from each end of the cylindrical portion.

9. The envelope according to claim 5, wherein each of said first insertion means has a cylindrical portion including two ends thereof, and one disk portion projecting inward and horizontally from each end of the cylindrical portion.

10. The envelope according to claim 5, wherein each of said first insertion means has a cylindrical portion and a disk portion which projects inward and horizontally from one end of the cylindrical portion while a second disk portion projects outward and horizontally from a second end of the cylindrical portion.

11. A color cathode ray tube comprising:

a vacuum envelope comprising a plurality of funnel sections each having a front and a rear side respectively, a plurality of neck sections, one neck section being arranged on each rear side of the funnel sections, a panel section including a face plate having an inner surface, and a skirt extending from a peripheral edge of the face plate, a metal connecting means for connecting each front side of the funnel sections to the skirt of the panel section, the metal connecting means having a main surface substantially parallel to the inner surface of the face plate, an outer surface, and a plurality of openings on the main surface corresponding to the front side of each of the funnel sections;

a phosphor screen disposed on the inner surface of the face plate;

a shadow mask disposed near the phosphor screen; and a plurality of electron gun assemblies, each of the electron gun assemblies being arranged in the neck sections, respectively.

12. The color cathode ray tube according to claim 11, wherein a plurality of reinforcing members are attached to the outer face of said metal connecting means, said plurality of reinforcing members serving to resist atmospheric pressure.

13. The color cathode ray tube according to claim 11, wherein said metal connecting means has a curvature which is the same as a curvature of the face plate, said metal connecting means is separated from the face plate by a certain distance, and is arranged perpendicular to the tube axis.

14. The color cathode ray tube according to claim 11, wherein said metal connecting means has a step between a first portion of said metal connecting means which is bonded to the skirt and a second portion of said metal connecting means which is bonded to the funnel sections, said second portion which is bonded to the funnel sections is spaced farther from the face plate than said first portion which is bonded to the skirt.

15. A color cathode ray tube comprising:

a vacuum envelope comprising a plurality of funnel sections each having a front and a rear side respectively, a plurality of neck sections, one neck section being arranged on each rear side of the funnel sections, a panel section including a face plate having an inner surface, and a skirt extending from a peripheral edge of the face plate, a metal connecting means for connecting each front side of the funnel sections to the skirt of the panel section, the metal connector means having a main surface substantially parallel to the inner surface of the face plate, an outer surface, and a plurality openings on the main surface corresponding to the front side of each of the funnel sections, a plurality of first insertion means for insertion between each of the funnel sections and the metal connecting means, said plurality of first insertion means having a thermal expansion coefficient lower than a thermal expansion coefficient of the metal connecting means, and, a plurality of second insertion means for insertion between the skirt of the panel section and the metal connecting means, said plurality of second insertion means having a thermal expansion coefficient lower than that of the metal connecting means;

a phosphor screen disposed on the inner surface of the face plate;

a shadow mask disposed near the phosphor screen; and a plurality of electron gun assemblies, each of the electron gun assemblies being arranged in the neck sections, respectively.

16. The color cathode ray tube according to claim 15, wherein a plurality of reinforcing members are attached to the outer face of said metal connecting means, said plurality of reinforcing members serving to resist atmospheric pressure.

17. The color cathode ray tube according to claim 15, wherein said metal connecting means has a curvature which is the same as a curvature of the face plate, said metal connecting means is separated from the face plate by a certain distance and is arranged perpendicular to the tube axis.

18. The color cathode ray tube according to claim 15, wherein each of said first insertion means has a cylindrical portion including two ends thereof, and one disk portion projecting outward and horizontally from each end of the cylindrical portion.

19. The color cathode ray tube according to claim 15, wherein each of said first insertion means has a cylindrical portion with two ends thereof and a disk portion projecting inward and horizontally from each end of the cylindrical portion.

20. The color cathode ray tube according to claim 15, wherein each of said first inserting means has a cylindrical portion with two ends thereof and one disk portion projecting inward and horizontally from one end of the cylindrical portion and a second disk portion projecting outward and horizontally from the other end of the cylindrical portion.

* * * * *